US009737778B2

(12) United States Patent
Keller

(10) Patent No.: US 9,737,778 B2
(45) Date of Patent: Aug. 22, 2017

(54) SPORTS TRAINING DEVICE

(71) Applicant: David Kevin Keller, Merrick, NY (US)

(72) Inventor: David Kevin Keller, Merrick, NY (US)

(73) Assignee: David K. Keller, Merrick, NY (US)

( * ) Notice: Subject to any disclaimer, the term of this patent is extended or adjusted under 35 U.S.C. 154(b) by 0 days.

(21) Appl. No.: 14/180,588

(22) Filed: Feb. 14, 2014

(65) Prior Publication Data

US 2015/0231468 A1 Aug. 20, 2015

(51) Int. Cl.

| | |
|---|---|
| ***A63B 69/00*** | (2006.01) |
| *A63B 71/06* | (2006.01) |
| *A63B 102/18* | (2015.01) |

(52) U.S. Cl.

CPC .. *A63B 69/0059* (2013.01); *A63B 2071/0602* (2013.01); *A63B 2071/0625* (2013.01); *A63B 2071/0655* (2013.01); *A63B 2102/18* (2015.10); *A63B 2220/80* (2013.01); *A63B 2225/09* (2013.01); *A63B 2243/0037* (2013.01)

(58) Field of Classification Search

CPC ..... A63B 69/0059; A63B 2102/18; A63B 2071/0602; A63B 2071/0625; A63B 2071/0655; A63B 2220/80

USPC ..... 473/422, 424, 221, 213; 368/10; 340/635; 482/45, 8; 273/189 R; 272/132

See application file for complete search history.

(56) References Cited

U.S. PATENT DOCUMENTS

| | | | | |
|---|---|---|---|---|
| 3,350,100 | A * | 10/1967 | Carmines | A63B 69/3608 446/404 |
| 3,606,343 | A * | 9/1971 | Lemon | A63B 71/146 473/213 |
| 4,222,569 | A * | 9/1980 | DeMascolo | 473/213 |
| 4,718,665 | A * | 1/1988 | Airy | A63B 21/015 482/119 |
| 6,852,067 | B2 * | 2/2005 | Limonadi | A61B 5/1125 400/704 |
| 8,123,624 | B2 * | 2/2012 | Caldwell | 473/221 |
| 2007/0072739 | A1 * | 3/2007 | Kaufman | A61H 1/0285 482/44 |
| 2007/0155544 | A1 * | 7/2007 | Killion | 473/424 |
| 2011/0234414 | A1 * | 9/2011 | Ojeda et al. | 340/635 |
| 2014/0160896 | A1 * | 6/2014 | Leoni et al. | 368/10 |

* cited by examiner

*Primary Examiner* — Aarti B Berdichevsky
*Assistant Examiner* — Christopher Glenn

(57) ABSTRACT

A sporting device designed to help improve and teach a person as well as a trainer the correct wrist snap motion for playing many sports. This device is comprised of an adjustable wrist band that will adjust to the person's lower ulna and radius bones. with a resistance, adjustable strap around the finger/knuckle that connects from the finger/knuckle to the wrist strap. This device has an audible unit and can also have a vibration attachment as well as a counting attachment added to the wrist strap for different uses in sports or physical therapy. When the trainee is training they will make the same motion they would when they are playing said sport. This device can be set at a desired level of resistance and distance for desired wrist snapping motion. The trainee or trainer can set the desired wrist snapping motion for the device objective. When the objective is achieved the unit will respond with either a sound and or a vibration to indelicate that the desired motion was reached.

5 Claims, 2 Drawing Sheets

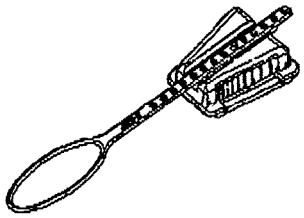
Fig. 1
Fig. 2
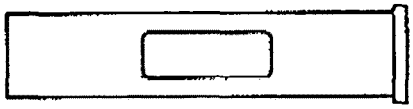
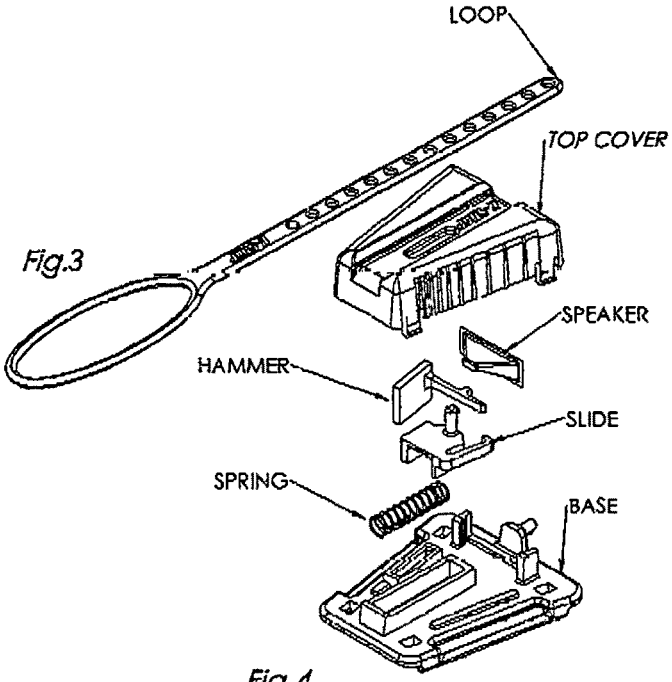
Fig.3
Fig.4
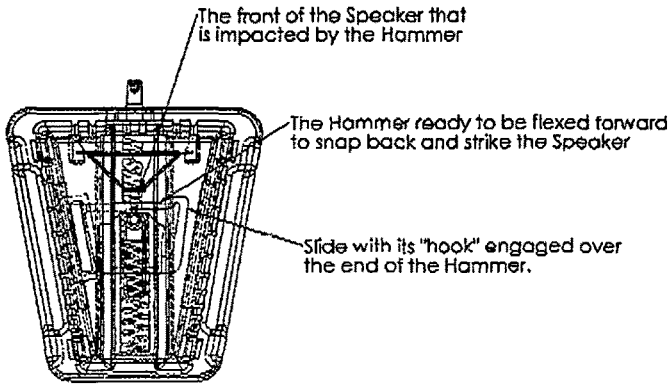
Fig.5

SECTION C-C

| ITEM NO. | PART NUMBER | | |
|---|---|---|---|
| 1 | Top | | |
| 2 | A9-36 | | |
| 3 | Hammer | | |
| 4 | Speaker2 | | |
| 5 | Bottom Mount-snap | | |
| 6 | Top-snap | | |
| 7 | Slide3 9-4-13 | | |
| 8 | Loop3- longer 11-20-13 | | |

Section View description of components (Fig. 9)

SPORTS TRAINING DEVICE

BACKGROUND OF THE INVENTION

The present invention relates to a sports training device and, more particularly, to a training device for sports that correctly teaches the art of snapping the wrist, as well as strengthen the wrist.

The most important factors in many sports are learning the correct fundamentals. When throwing a ball, one must correctly snap their wrist. When throwing a baseball or shooting a basketball, one must not only snap their wrist, but also, their fingers must flow with the snapping. Similar actions are present in many other sports as well. However, there are currently no good ways to teach this fundamental behavior.

Current devices do not allow for wrist snapping for throwing balls, hitting clubs, shooting basketballs, or the like. Current devices also do not allow for muscle memory and are often designed for one purpose and are not adjustable. As can be seen, there is a need for an improved sports training device that may be used to teach the art of snapping one's wrist in the appropriate fashion for the particular sport.

BRIEF DESCRIPTION OF THE DRAWINGS

FIG. 1 Shows the invention ready for the action intended with the Loop attached to the Slide. This is an overall perspective view of a sports training device according to an exemplary embodiment of the present invention being worn on a user's wrist;

FIG. 2 is a wrist strap comprising of Velcro at one end and a loop on the opposing end. On the top of the wrist strap is another Velcro strap that secures FIG. 1 to the wrist strap.

FIG. 3 is the knuckle strap that has a Loop on one end and has multiple holes that can fit over the protruding pin on top of the Slide on the opposing end. This Loop is adjusted for the proper length from the wrist strap mount to where the Loop fits over the player's knuckle. When the hand of the player is bent backward and then toward, in the proposed action, the Loop pulls the Slide which then pulls on the Hammer until at a point where the Hammer then snaps back.

FIG. 4 shows a view of an assembled clicking device according to an exemplary embodiment of the present invention; comprising of a top cover, hammer, speaker, slide, spring and a bottom based that encloses the above parts. Upon the Hammer snapping backward, it hits the vacuum formed Speaker which emits a loud "crack" sound, indicating the proper action of the player. The internal Spring returns the Slide to its starting position when the Player starts the sequence again. The hook of the Slide, at the top resting position, curves over the end of the Hammer. When this Slide moves forward, it bends the arm of the Hammer until it snaps back striking the forward funnel shape of the Speaker. The Speaker is shaped like a cone to further amplify the sound that the Hammer makes in striking the Speaker. At the rear of the Top Housing, is a stationary "pin" that allows the user to attach the "Loop" to exercise their wrist and hand without actuating the sound. The Base has two "rungs" on either side to allow the unit to be fitted onto a wrist strap and worn by the user during game play.

FIG. 5 is a top view of the of the clicking device of with a transparent cover cut to show inside of device and inner workings, with part descriptions; speaker, hammer, slide and spring.

DETAILED DESCRIPTION OF THE INVENTION

Figure 6:
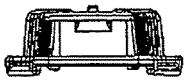
FIG. 6 is a side view a the clicking device from the front.
Figure 7:
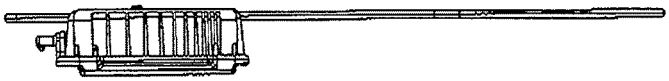
FIG. 7 is a side view of the clicking device is assembled for use and Clarity to show; Showing the assembly of the unit. This shows the descending loop that secures the housing to the wrist strap.
Figure 8:
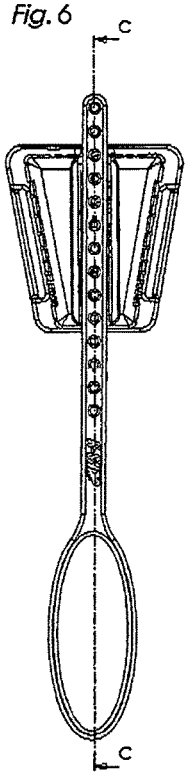
FIG. 8 is a view from the top the unit that shows how the knuckle strap connects to the clicking unit.
Figure 9:
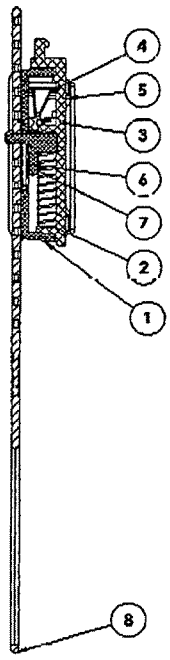
FIG. 9 is a cut view from the side that shows the inner parts of the clicking unit.
Figure 10:
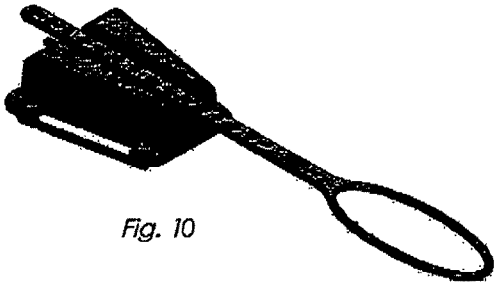
FIG. 10 is a This is an overall perspective view of a sports training device according to an exemplary embodiment of the present invention being worn on a user's wrist.
Figure 11:
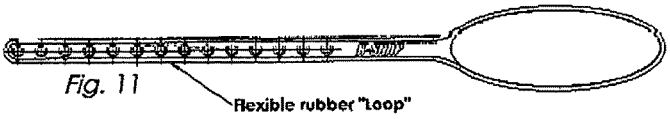
FIG. 11 is a top view of the knuckle strap that shows the multiple hole at the opposing end of the knuckle loop.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a training device for many sports to correctly teach the art of snapping the wrist for throwing, shooting balls and swinging clubs, for example. The device includes a strap wrapped around the forearm with one or more clicking/sounding units attached on top of the strap. One or more finger straps can be placed around the base of the fingers. An elastic band can interconnect the wrist strap and/or the one or more clicking/sounding units with the finger straps. By feeling and hearing the correct wrist snapping, the player will develop muscle memory. The device of the present invention allows the player to practice with it on them, developing their skills. This will also allow the training/coach hear if the proper mechanics are being used.

The device of the present invention can be adjusted for many sizes and can be adjusted for many uses. The device creates a sound and/or a vibration that builds muscle memory faster than the sound alone can do so. The device can also be used for muscle development by changing the bands that will have more resistance for strength training.

Referring now to the Figures, an armband may be made from an adjustable strap that can wrap around the forearm of the user. One or more clicking/sounding devices may be disposed on this strap. Typically, one clicking/sounding device is disposed on the top of the armband. On each side of the clicking device, a band clip can be attached to the armband. The band clips may be used, for example, for strength training purposes, where the clicking unit is not needed.

One or more finger straps can be designed to be placed around the base of the user's fingers, typically over the knuckle. The finger straps can include a band clip attached to the top thereof. Resistance bands can interconnect the armband/clicking/sounding device with the band clips on the finger straps. The resistance bands may be adjustable for the players size and range of motion they desire.

A finger attachment may be a material of desired size that can be added or attached to the inside of the finger band to give the proper spacing between the palm of the hand and the ball, assisting, for example, in developing correct spin of the ball.

As the player performs the correct fundamentals in their sport, the clicking device will make a sound and produce a click vibration for muscle memory. This action is as a result of the wrist and fingers moving from one direction to another direction. The instant feedback, while actually practicing the motion, helps the player develop a muscle memory to reinforce the behavior, even after the device is removed.

While Figure's shows one embodiment of a clicking/sounding device usable with the sports training device of the present invention, various mechanisms are contemplated within the scope of the present invention as usable to create a clicking sound and create a click vibration when the resistance band is extended or released.

The armband can be made of a stable fabric with a hook and loop fastener, such as Velcro® attached to it to allow for the adjustable sizing. The finger bands can be made of a soft fabric with a more stable fabric attached to the top of the soft fabric that lies over the knuckle. The band clips may be made from various materials, such as plastic, with a teeth-like clip or plugs that can snap down and retain the resistance bands or hole in the resistance bands that could be fastened by plugs. The clicking device can be made of various materials, such as a plastic tube with springs inside of it, for example.

The resistance bands may be made from various materials, such as surgical elastic rubber that is typically flat in Its cross-section. These flat elastic bands can have different resistances and may be made in various thicknesses. The finger palm attachment may be made of a soft, solid gel with a button for attachment to the finger strap, for example.

Referring to Figures, an exemplary embodiment of a clicking device is shown. This clicking device allows the elastic band to be attached and provide a clicking sound when the elastic band is properly snapped according to the desired result. The clicking device may fasten via a look and loop fastener to the wrist band. It should be noted that these figures show one specific embodiment of the clicking device and other clicking devices that achieve a similar result may be used within the scope of the present invention.

To use the device of the present invention, a player can put the device on and perform the sport activity they are playing. The device would allow the player and the coach to hear and feel the correct movement of the wrist and fingers for the player to obtain muscle memory. The unit will provide the player the correct feedback to promote the right fundamentals for their particular sport activity.

It should be understood, of course, that the foregoing relates to exemplary embodiments of the invention and that modifications may be made Without departing from the spirit and scope of the invention as set forth in the following claims.

This unit also can have an electronic attachment that will keep count of the proper wrist motion and are able to send data to a device for further use.

What is claimed is:

1. A sport training device for teaching proper wrist snapping techniques, comprising of: an adjustable wrist strap that secures immediately above a wrist; a knuckle strap comprising two ends, wherein one end is ring like and slips over a user's knuckle immediately around a knuckle, and wherein the opposing end is notched with many holes; a clicking device that is attached to a top of said adjustable wrist strap, wherein said device comprises a housing that has a top and bottom where a speaker, spring, hammer and slide mechanism for creating an audible sound are inside said housing, as well as a hook extending from the top of the clicking device housing for attachment to one of said holes in a knuckle strap; wherein said clicking device produces an audible sound when said knuckle strap is pulled by a bending wrist a predetermined distance set by the user depending on the sport and his/her age.

2. The sport training device according to claim 1, wherein said clicking device has two descending strap holes connected to said bottom of said housing of said clicking device; said descending strap holes are for securing said clicking device housing to said wrist strap.

3. The sport training device according to one of claims 1 and 2, wherein said knuckle strap is comprised of a resistance like material that is interchangeable for more or less resistance; knuckle strap having many holes at one end (the end that affixes to a clicking device) and the other end having a large loop.

4. The sport training device according to any one of claims 1, 2 and 3, wherein the sporting device has a resettable counter to keep track of an amount of times the slide moves a set distance.

5. The sport training device according to any one of claims 1, 2, 3 and 4, wherein a hammer creates a vibration in said clicking device.

* * * * *